United States Patent [19]

Collins, Sr. et al.

[11] 4,052,703

[45] Oct. 4, 1977

[54] INTELLIGENT MULTIPLEX SYSTEM FOR SUBSURFACE WELLS

[75] Inventors: Jerry Alan Collins, Sr.; Robert Lynn Spaw, both of Houston, Tex.

[73] Assignee: Automatic Terminal Information Systems, Inc., Houston, Tex.

[21] Appl. No.: 574,519

[22] Filed: May 5, 1975

[51] Int. Cl.[2] ..... E21B 7/12

[52] U.S. Cl. ..... 364/200; 166/.5

[58] Field of Search ..... 340/172.5; 166/.5, .6; 175/6

[56] References Cited

U.S. PATENT DOCUMENTS

| | | | |
|---|---|---|---|
| 3,353,594 | 11/1967 | Lewis | 166/.6 |
| 3,516,491 | 6/1970 | Lewis | 166/.6 |
| 3,546,474 | 12/1970 | Decourcy et al. | 290/52 |

*Primary Examiner*—Gareth D. Shaw
*Assistant Examiner*—C. T. Bartz
*Attorney, Agent, or Firm*—Carlos A. Torres; E. Richard Zamecki

[57] ABSTRACT

A subsea well installation is equipped with means for performing required control functions as directed by electrical command signals transmitted over a primary cable from a remote surface location. The subsea installation includes a logic system which effects desired normal or emergency control functions according to self-contained programs or in accordance with instructions received from the surface. Multiplexing means at both locations substantially reduce cable dependency and reduce the number of electrical conductors required in the cable. Cable dependency and signal traffic are further reduced by the provision of self-contained means in the subsea logic system which verify that correct instructions have been received without need for retransmitting the received instructions to the surface. When the primary cable is damaged or communications are otherwise interrupted, a special subsea logic is initiated to control operation of the well installation and a submerged buoy is automatically released. An auxiliary cable is carried by the buoy to the water surface to permit power and communications to be reestablished with the underwater installation. The buoy may also carry a storage battery or the subsea logic system, or both, so that the buoy may be released to carry these components to the surface as required for repair or periodic maintenance. Communications and power connections between the underwater installation and the cable are established through waterproofed, inductive coupling means which permits the cables to be quickly and easily connected and disconnected from the well installation without diver assistance.

11 Claims, 9 Drawing Figures

SURFACE MULTIPLEX UNIT

INTELLIGENT MULTIPLEX SYSTEM FOR SUBSURFACE WELLS

BACKGROUND OF THE INVENTION

Many oil and gas bearing formations lie below large bodies of water. Producing wells extending into these formations are frequently equipped with underwater wellheads and other underwater installations which rest at the bottom of the water bodies. During drilling of the wells, it is also customary to employ special underwater well installations which provide blowout protection and other drilling related functions. These various underwater well installations may be equipped with valves, pipe shearing rams and blowout preventer rams, as well as a variety of other mechanisms which are usually hydraulically powered. By way of example, the flow valves in production wells must be closed at the subsurface well head if the pipeline which the wells feed is damaged. In other cases, optimum production from a well may require that the opening through a variable flow passage at the well head be changed to control the well pressure. Drilling installations frequently employ submerged blowout preventer means which close around the drill string or, in some cases, shear the drill string to prevent or stop uncontrolled flowing of the well.

In shallow water, the majority of the well installations are totally controlled hydraulically. These all-hydraulic systems usually employ a hydraulic, subsea multi-hose bundle which connects the surface and the subsurface facilities. Individual hoses supply hydraulic power from the surface to the well installation to monitor the status of the subsea equipment as well as to perform control operations. The advantages of these types of systems are that they are simple, reliable, and inexpensive for short separation distances. The major disadvantage is that response time is usually very slow. Moreover, when used in deep water installations, the cost and response time of the subsea hoses increase and reliability decreases.

Electro-hydraulic systems were introduced to overcome the disadvantages of the all-hydraulic systems in deep water or long distance applications. The electro-hydraulic subsea cable typically employs a control hydraulic line supplying hydraulic operating power to the well installation and, in the same cable, a plurality of insulated electrical conductors which control electro-hydraulic solenoids, power subsea transducers and carry output electrical signals from the transducers to the surface.

While conventional, multi-conductor electrical cables with integral fluid supply lines have been satisfactory for many underwater well installations of the electro-hydraulic type, such cables are also expensive and have many operating limitations. The expense of the cable increases significantly and its performance deteriorates rapidly as the distance between the underwater installation and the remote surface control station increases. The advent of more sophisticated underwater well installations has also increased the need for increased communications and power supply capacities between the underwater installation and the surface control station. In conventional systems, these increased capacities have required the addition of more electrical conductors and larger fluid conduits which in turn has further increased the expense of the cables.

Because of the absolutely critical nature of some underwater control functions, such as the closing of a valve to stop well effluents from flowing into the water from a damaged well head or pipeline, it is essential to maintain control over the underwater installation. Such control requires some means to ensure that a particular command signal is accurately transmitted to the underwater installation. A conventional verification technique, which is time-consuming and increases the duty cycle of the cable, requires that the received signal be retransmitted to the surface for comparison with the original signal. If the transmitted and received signals are not the same, the control function is not completed.

As the number and length of communication pathways in the cable increase, the potential for malfunction of the underwater system also increases. Any malfunction in these cables can be expensive to repair and may also give rise to extremely dangerous conditions due to the high pressure, flammable characteristics of the well effluents in the underwater well installations.

SUMMARY OF THE INVENTION

An underwater well drilling or production installation, of the type having electric, or electro-hydraulic controls, is equipped with an intelligent multiplex system which significantly reduces reliance on a surface connected cable. Cable dependency is reduced by providing underwater logic circuitry which contains one or more operating programs and which is operatively connected with the electric or electro-hydraulic mechanisms in the installation. The subsea and surface logic systems permit the number of electrical conductors required in the cable connecting the underwater well installtion with a remote control point to be substantially reduced. A further significant reduction in the number of conductors required in the cable is effected as a result of the use of a multiplexing receiver and transmitter means in the underwater well control system whereby command instructions and messages may be relayed back and forth between the surface control point and the underwater well assembly over a single pair of conductors.

The subsurface logic is equipped to operate the well according to a predetermined program corresponding to normal operating conditions or to initiate a special program when the primry cable is damaged or when other interference occurs between the surface control point and the underwater control means. Where the underwater system remains stable and functions normally, substantially normal operations of the underwater system may continue while the interruption of normal communiations and power supply is corrected. In the event abnormal conditions occur during the time that direct communications with the surface are interrupted, the subsurface system includes a special program which automatically initiates emergency procedures.

A multiplexing receiver-transmitter means provided at the remote surface location permits the reception and transmission of multiplexed data to cooperate with the multiplexing means in the underwater system. By this means, extensive communications between the surface control point and the underwater control means may be effected over a very small number of electrical conductors.

The underwater logic system is provided with means to recognize whether or not a command signal transmitted from the surface control point has been correctly received without need for returning the received signal to the surface for verification. With this improvement, the benefit of a signal verification system is provided without need for increasing the duty cycle or message carrying capacity of the cable connecting the surface and subsurface locations.

Means are also provided for automatically releasing a submerged buoy when the primary cable connecting the underwater and surface facilities is broken, or damaged, when communications between the two points are otherwise disturbed or when other specified problems occur in either the installation, cable or surface facilities. The buoy carries a secondary cable to the water surface to mark the location of the underwater well installation and to permit reestablishment of surface communications and surface supplied power as well as permit the continued supply of charging power to batteries and hydraulic accumulators in the underwater system. The buoy may also carry a battery means or the subsea logic system, or both, which are taken to the surface pursuant to an appropriate surface initated command so that the battery and logic system may be tested, serviced, or replaced at the surface. Once the surface operation is completed, the buoy may be commanded to return to its subsurface location.

The communications and electrical power conductors in the cable are coupled with the communications and electrical power conductors in the control systems by a mutual inductance linkage in the cable rather than by a direct electrical contact linkage. By this means, the submerged end of the underwater cable and the connecting end of the underwater control system may be completely waterproofed, but yet the two ends may be quickly separated or electrically reconnected by simply being placed in close physical proximity. This arrangement reduces the danger of leakage which is present where physical contact between electrical connectors is required.

From the foregoing it will be appreciated that one of the primary objects of the present invention is to provide an underwater wellhead, drilling installation or other underwater well installation with a self-contained logic control and power system capable of controlling operation of the underwater installation in the event of loss of, or damage to, the cable connecting the underwater installation with a remote surface control means.

Another object of the invention is to provide an underwater logic system which is capable of controlling the operation of control functions in the underwater well installation under normal operating conditions with only limited reliance on signals received over the cable connecting the underwater well installation with the remote surface control station.

It is an object of the invention to provide a system for controlling and monitoring the operation of electro-hydraulic equipment and transducers contained in an underwater well installation through use of a relatively small cable means connecting the underwater well installation with a remote surface location whereby the cable means supplies electrical and hydraulic power or communicates surface generated command signals or communicates subsurface generated signals to the surface.

A further object of the invention is to provide a control system capable of determining the validity of a message received over a cable without having to retransmit the message to the remote control station.

Yet another object of the present invention is to provide a system having the ability to diagnose problems by running self-testing programs.

Another object of the present invention is to provide a control system that can communicate with humans to monitor the well status, or to alert the operator of problems or malfunctions in the remote facility.

Still another object of the present invention is to provide a control system that allows only authorized personnel to control the underwater well installation.

An important object of this invention is to provide a subsea installation with a self-contained power and control system which may be remotely monitored or controlled from a remote station and which automatically provides a means for direct surface access to the installation in the event of damage or malfunction of the installation or the cable connecting the installation with the remote station.

It is a specific object of the invention to provide a submerged buoy as the means for providing direct surface access whereby such buoy may be released, automtically or on command, to transport an auxilliary cable to the surface to reestablish communications and power or to permit surface access to equipment carried in the buoy.

It is a general object of the present invention to provide a system of the type herein described which is not ncessarily limited to well application or to submerged facilities but which is employed for controlling or monitoring one or a plurality of separate installations from a single remote control station.

Other features, objects and advantages of the invention will become more readily apparent from the accompanying drawings, specification and claims.

DESCRIPTION OF THE ILLUSTRATED EMBODIMENTS

Figure 1:
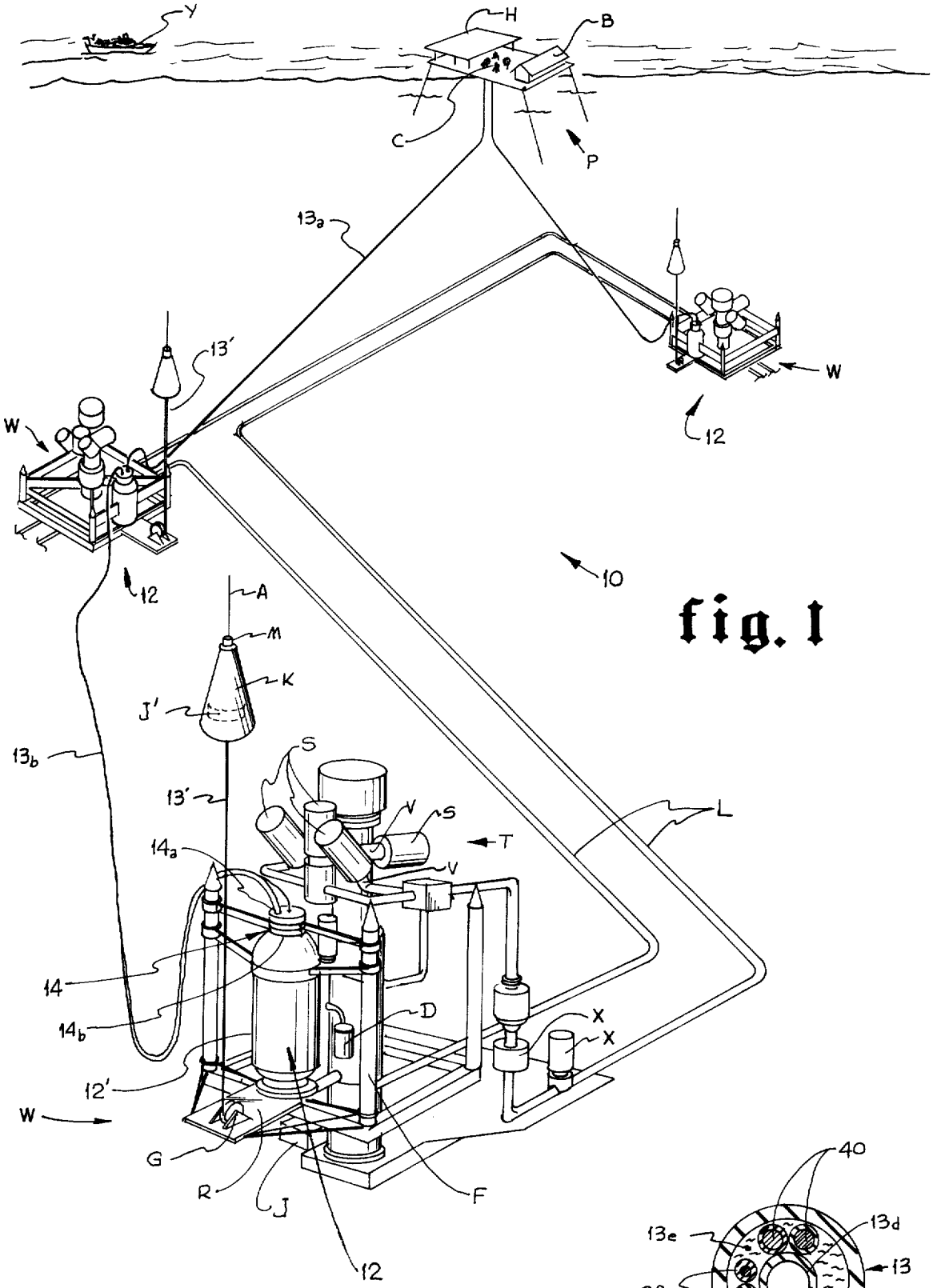
FIG. 1 is a perspective view illustrating an offshore platform and a plurality of underwater well installations employing the automated subsea control system of the present invention.

Refering now to the drawings, and more particularly to FIG. 1, the intelligent multiplex well control system of the present invention is indicated generally at 10. The well control system 10 includes a remote surface control unit 11 (FIG. 2) located on a platform P and one or more subsea control units 12, used to control and monitor one or more subsea well installations W. The installations W are production installations but may be any installation at which control or monitoring operations are to be conducted. The control unit 11 includes a suitable water proof housing 12' which protects the internal operating components of the unit.

The platform P, which is conventional, may include a suitable building B housing the remote surface control unit 11 (not illustrated in FIG. 1), a plurality of cable and wireline reels C and a heliport H. The well installations W typically include a wellhead framework F, and a christmas tree T equipped with a plurality of control valves and monitoring devices depicted at V and X respectively. Suitable pipelines L are employed to carry well effluents from the well installations W to remote storage tanks or other facilities (not illustrated).

Typical subsea installations are disclosed at pages 4759–4776 in the 1974–75 Stewart & Stevenson Oil Field Division General Catalog which is published in the 1974–75 Composite Catalog of Oil Field Equipment and Services, Gulf Publishing Company. The well installations W employ electro-hydraulic solenoids S to control the valves V. The solenoids are controlled by either the surface control unit 11 or the subsea unit 12. The subsea control unit 12 and remote surface control unit 11 are linked by a suitable primary electro-hydraulic cable 13 which is illustrated as being formed in sections 13*a* and 13*b*. A retrievable pad R, attached to the wellhead framework F, supports the subsea unit 12. The pad R is of conventional design and is releasably attached to the well installation in any suitable manner, as described, for example, in the previously mentioned Stewart & Stevenson General Catalog.

The cable section 13*b* is connected with the unit 12 through an electromagnetic coupling 14, comprised of sections 14*a* and 14*b*. The section 14*a* is attached to the cable 13*b* and the section 14*b* is attached to the unit 12. The electromagnetic coupling 14 allows a non-contact communications and electrical power link when the two sections are brought close together so that the communications and electric power lines in the two sections are inductively coupled. The hydraulic line carried in the cable section 13*b* terminates in a conventional quick-coupling and release connector (not illustrated) in the section 14*a* which engages a conventional mating connector (not illustrated) in the section 14*b* to supply and pressurize hydraulic fluid contained in an accumulator D.

A releasable subsea buoy K connected to a secondary cable 13' is employed to establish an emergency power and communications linkage with either the remote surface unit 11 or a work boat Y which may carry an alternate surface control unit (not illustrated), identical to the unit 11. Under normal operating conditions, the main portion of the cable 13' is stored in a reel G which is prevented from rotating by the control 12. Any disruption in normal communications or power supply over the primary cable 13 is sensed by the control unit 12 which releases a rotary brake acting on the reel G. This in turn permits the cable 13' to unreel from the reel G so that the buoy K may float to the surface. At the surface, the vessel Y may pull the buoy K aboard and connect the cable 13' to its on-board control and power supply unit which can establish normal control and monitoring functions and keep the subsurface batteries J and the hydraulic accumulator D charged until the primary cable 13 becomes functional. The buoy may also be equipped with a marker light M and an antenna A. The antenna is employed for transmitting locator signals generated by a transmitter contained either in the buoy or in the unit 12. By this means, the buoy may be located with conventional radio triangulation means if visual location is not possible. Once the primary cable is repaired, the control unit 12 may be signalled to reel in the cable 13' and attached buoy K so that the buoy may be redeployed as required. If desired, the buoy K may also carry a battery pack J' which may either replace or supplement the battery pack J. Placement of the battery pack J' in the buoy K permits the battery pack to be transported to the surface for testing or replacement.

Figure 2:
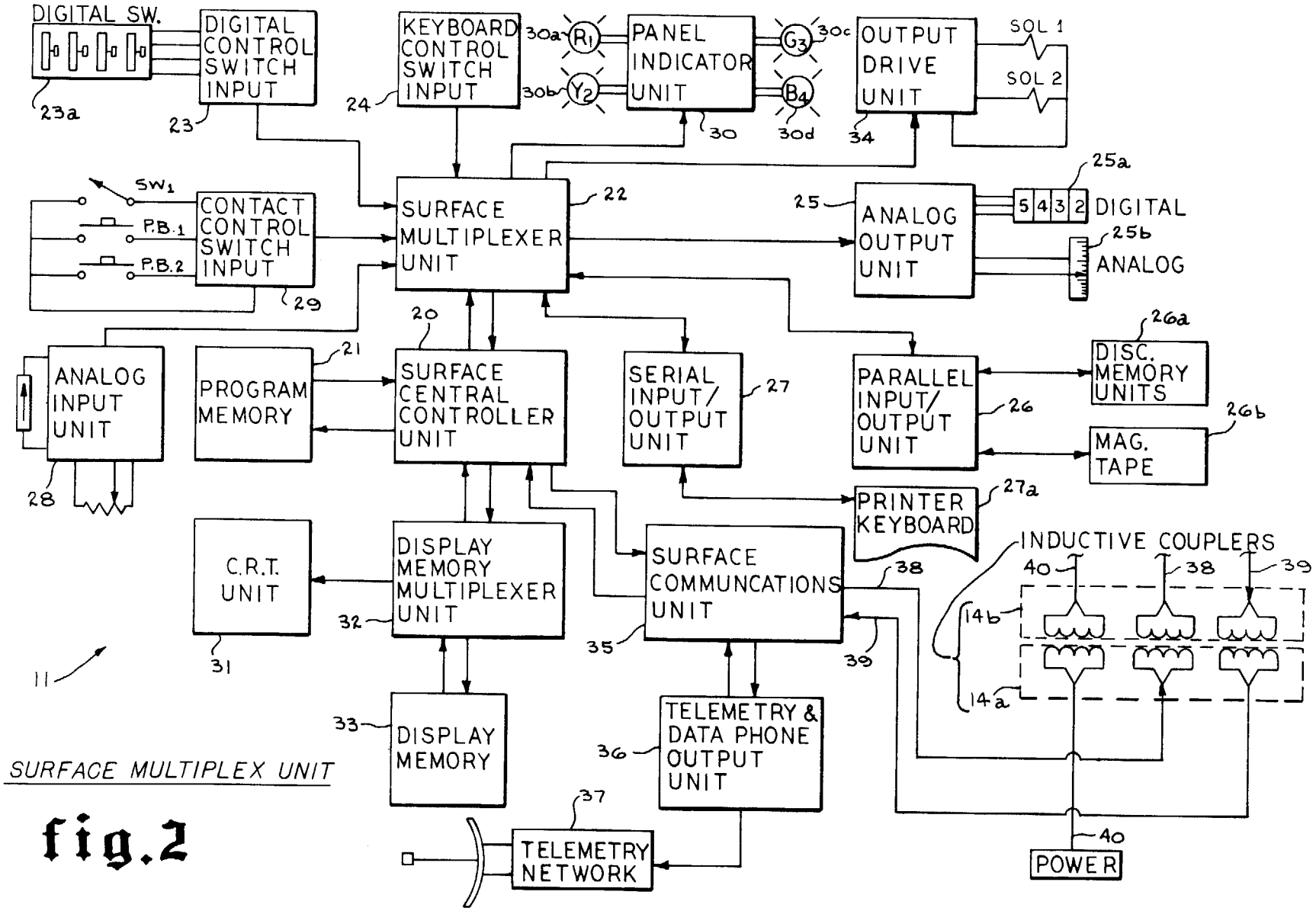
FIG. 2 is a block diagram of the remote surface control portion of the present invention.

Details in the remote surface control system 11 are illustrated in FIG. 2. The heart of the control system 11 is an eight-bit parallel central controller or control processing unit (CPU) 20. The CPU 20 may be, for example, a conventional Model 8080 microcomputer available from Intel Corporation, Santa Clara, California or any other suitable CPU. The CPU 20 interprets incoming data and sends it to the proper peripheral unit as determined by a pre-engineered program stored in a program memory unit 21. The unit 21 preferably includes a conventional non-erasable read-only memory (ROM), and a scratch pad memory, the latter being for temporary control storage. The unit 21 controls the scanning, switching, selection of routes, data limits and contains the control information required to keep the unit 11 operational.

Human-to-machine and machine-to-human communications are provided by a surface multiplexer unit 22. The unit 22 serves as a conventional multichannel multiplexing analog-to-digital converter system as well as a digital-to-analog converter system. A typical multiplexer unit suitable for use in the present invention is distributed by Analog Services, Inc. of Norwood, Massachusetts as its Model MPX-8A. The multiplexer 22 accepts external command and data signals, both digital and analog, which are generated, for example, by peripheral equipment to control the CPU 20 and also routes signals from the CPU 20 to various peripherals.

The peripheral equipment connected with the multiplexer 22 may include digital control switch inputs 23 controlled by a digital thumbswitch assembly 23*a* for password entry, well selection, and modulating control. The unit 23 provides the interface circuitry required to isolate contact noise in the switches 23*a* from the input circuitry to the multiplexer 22. In the preferred form of the invention, the noise isolation is obtained through the use of photocouplers.

A keyboard control input 24 provides an interface for entry from a keyboard when the unit 11 is optionally used as the master control unit for a manual control data processing center. Digital signals from the multiplexer 22 are supplied to an analog output unit 25 which includes a buffer storage to hold digital data being displayed on a digital display 25*a*. a digital-to-analog converter in the unit 25, supplied from the buffer storage, drives conventional analog meter movements 25*b*. Also included in the surface unit 11 is a parallel input/output unit 26, with a buffer storage capacity, for interfacing disc memory units 26*a* and/or magnetic tape or other type external recorders 26*b*. The buffer storage cushions the flow of data into and out of the multiplexer 22. A serial input-output unit 27 connected to the multiplexer 22 permits serial data to be received from a teletype or transmitted to a printer 27a. An analog input unit 28 provides an analog-to-digital conversion for converting external analog signals to digital conversion for converting external analog signals to digital form to be supplied as digital inputs to the multiplexer 22.

Manual control of the valves, blow-out preventers and other devices in the subsea well installations is effected, for example, with control panel switches such as SW1, and push buttons PB1, and PB2, included in a contact control switch input unit 29. The unit 29 includes anti-bounce controls for the switches and pushbuttons and is also photoisolated from the associated circuitry. The switches or pushbuttons are associated with a panel lamp such as 30a, 30b, 30c and 30d included in a graphics panel indicator unit 30. The panel indicator 30 provides a visual display of the status of the subsea well installation to the operator. By way of example, the lamps 30a–30d may be designed to light up when the valve which they represent is open and to turn off when the valve is closed. For purposes of selectively displaying vital information, such as well head pressure and other variables, of each individual well, a cathode ray tube (CRT) unit 31, equipped with a CRT, refresh memory and timing circuit, is employed. A display memory multiplex unit 32 and a display memory 33 cooperate to provide input data for display on the CRT of the unit 31. The memory 33 is a high speed memory storage whose contents can be viewed by operating personnel on the display screen of the CRT unit 31. The unit 32 switches control from the CRT unit 31 to the central controller unit 20 and back to enable the unit 20 and the unit 32 to access the display memory 33. By this means, the controller time required to write to the CRT screen of the unit 31 is substantially reduced.

Control of the surface equipment which requires the use of heavy solenoids, motor starter and electric actuators and the like is effected by an isolated interface output drive unit 34.

A surface communications unit 35 is utilized to communicate with a subsea well installation. The communication unit 35 includes circuitry for sterializing input data, parity generation, frequency shift key conversion (FSK) and line driving of the data leaving the surface controller 20. The unit 35 also includes circuitry for decoding an FSK data signal transmitted from the subsea controller whereby the subsurface FSK data signal is decoded to serial digital data and shifted to the controller 20 in parallel form. The communication unit 35 provides for parity, framing 20 of such errors. The described functions of the unit 35 may be provided by any suitable, conventional means.

In some situations it may be desirable to telemeter data from the system 10 to remote locations. In such cases, a telemetry and data phase output unit 36 may be employed to provide operation over dedicated lines or voice grade phone lines as well as to provide for FSK outputs for suitable telemetry equipment 37 which beams data to satellite links or other high frequency radio communications systems.

Electrical power and data linkage between the surface control unit 11 and the subsea control unit 12 is achieved over the electrical conductors in the primary electro-hydraulic cable 13 (FIG. 1). Data from the surface control unit 11 is transmitted down to the subsea control unit 12 over a twisted pair cable 38 through the inductive couplings 14a and 14b while data from the subsea control unit 12 is transmitted to the unit 11 over a twisted pair cable 39 through the same couplings. If desired, two-way transmission over a single twisted pair cable may be employed. Electrical power is transmitted over a twin conductor 40 through the inductive coupling 14 to the subsea installation.

Figure 4:
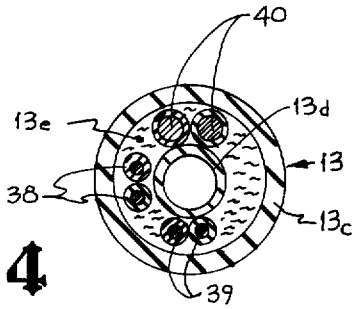
FIG. 4 is a cross-sectional view illustrating the construction of a typical underwater electro-hydraulic communications cable employed in the present invention to link the remote surface control station with the subsea installtion.

FIG. 4 illustrates the electro-hydrulic cable 13 in cross-section. Depending on the application, the cable 13 may include an armor sheath (not illustrated) to provide added strength to the cable. The cable 13 is of conventional construction and includes a smooth polyurethane cover 13c, a centrally located hydraulic hose 13d, and suitable insulative packing or spacing material 13e. The twisted pair cables 38 and 39 are carried within the cover 13c and spaced by the packing 13e. Each of the twisted pair cables includes two electrically insulated conducting wires. Power to the subsea control unit 12 is provided by the similar, but larger, twisted pair cable 40. The hydraulic hose 13d is utilized to maintain a trickle charge on the hydraulic accumulators D (FIG. 1) located in the subsea installation. The accumulators provide either back-up or primary power for actuating the subsea valves and controls.

Electrical power to operate the subsea control unit 12 is obtained from the batteries J or J' which may comprise any suitable rechargeable electric storage battery or battery pack. Under normal operating conditions, the batteries J and J' are trickle charged from the surface with an AC power signal transmitted over the twisted pair cable 40. A conventional rectifier circuit in the subsea unit 12 converts the AC power signal on the lines 40 to a rectified power signal which is transmitted to the batteries J and J' as required to keep the batteries charged.

Figure 3:
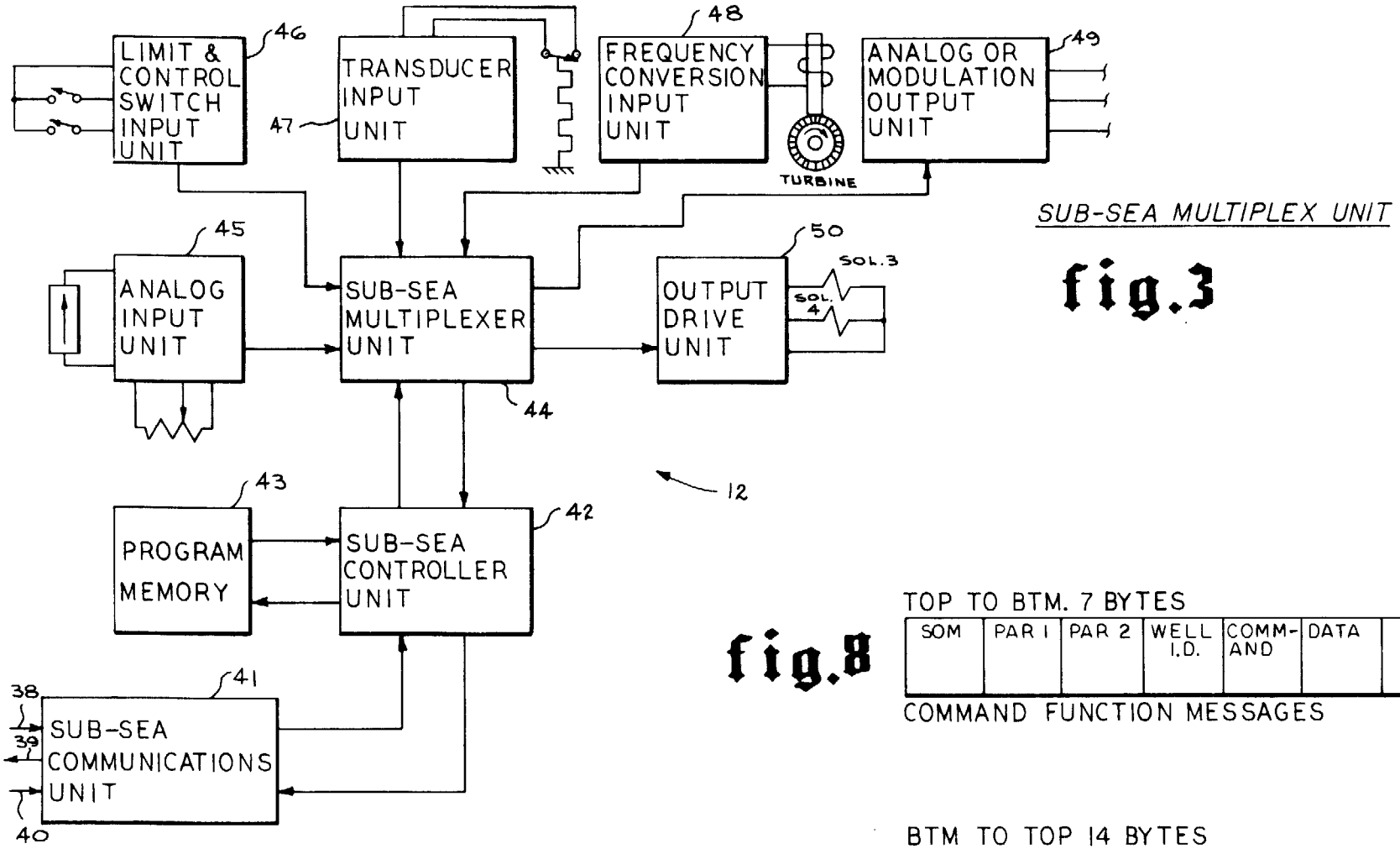
FIG. 3 is a block diagram of the subsea control portion of the present invention.

The internal operating components of the subsea control unit 12 illustrated in FIG. 3 includes a subsea communications unit 41, a subsea central controller unit or CPU 42 equipped with a program memory 43, and a subsea multiplex unit 44. Also included in the unit 12 is various peripheral equipment such as an analog input unit 45, a limit and control switch input unit 46, a transducer input unit 47, a frequency conversion input unit 48, an analog or modulating output unit 49 and an output drive unit 50.

The subsea communications unit 41, CPU 42, program memory 43 and subsea multiplex unit 44 are identical to the surface units 35, 20, 21, and 22, respectively. The analog input unit 45 includes an analog-to-digital convertor for converting analog signals generated by temperature transducers, pressure transducers and the like to digital signals for processing by the CPU 42. The analog input unit 45 may also be employed to indicate the position of variable chokes and other analog-type equipment. The limit and control switch input unit 46 and the transducer input unit 47 are identical and are employed to indicate extreme positions of valves, whether they are fully open or fully closed, and to indicate either a high or low pressure limit or temperature limit. The frequency conversion input unit 48 is employed to translate an incoming pulse frequency signal into digital form so that it is compatible with the CPU 42. The frequency signal may be generated by a typical flowmeter to other conventional means often employed to measure flowrate. The analog or modulating output unit 49 employs a digital-to-analog converter for generating an analog signal which is used to control modulated valves or variable chokes and the like. The output drive unit 50 provides the control signal for actuating the hydraulic solenoids or other devices which are employed to open and close the subsea valves, release the buoy, or provide other well control functions.

Figure 5:
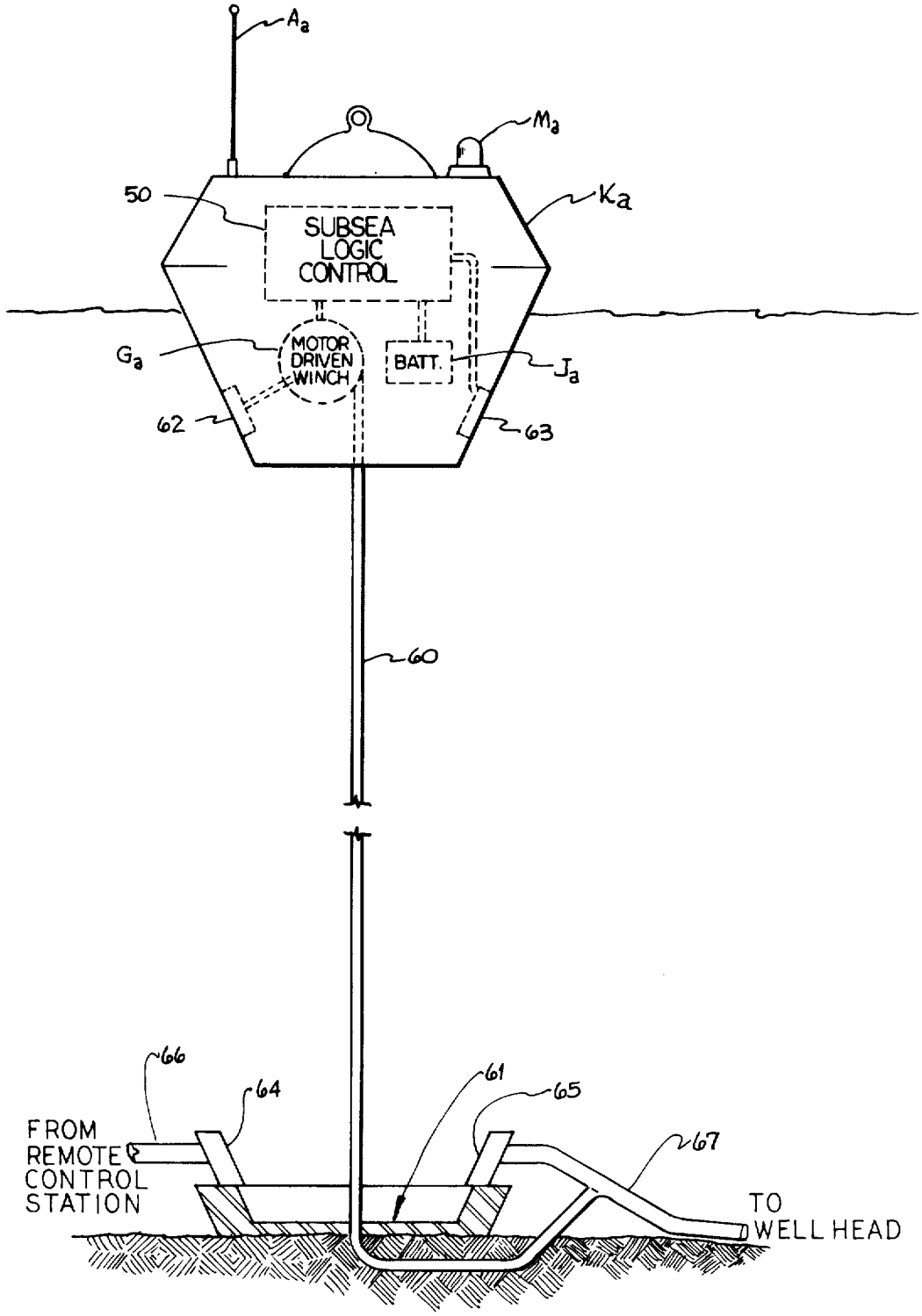
FIG. 5 is a vertical elevation, partly in cross section, illustrating a modified form of the invention in which the subsea logic control and battery means are carried in the buoy.

FIG. 5 illustrates a modified form of the invention in which a buoy K*a* serves to house a subsea logic control means 50, battery J*a* and an electric motor driven winch G*a*. The buoy is also equipped with a signal light M*a* and antenna A*a*. A cable 60 extends from the buoy to a subsea landing station 61. When appropriately signalled by the subsea logic control 50, either through an instruction commanded from the remote surface control station or through an instruction generated internally within the logic control system 50, the motor driven winch G*a* is actuated as required to permit the buoy to float to the surface of the water to the position shown in FIG. 5, or to return the buoy to a seated position within the landing station 61.

If desired, sutable waterproofing means may be provided so that the cable 60 may move into and out of the buoy K*a* without permitting water entry to the internal portions of the buoy. Alternatively, the subsea logic control 50, battery J*a* and any other components inside the buoy may be individually waterproofed and the buoy may be constructed of material which provides the necessary flotation.

When the buoy K*a* is landed in the landing station 61, electrical connections for both power and communication pathways are reestablished by placing two waterproofed inductive coupling coil connectors 62 and 63 in the buoy in close physical proximity with matching connectors 64 and 65. With the connector 62 adjacent the connector 64 and the connector 63 adjacent the connector 65, an inductive coupling is established which permits power and communication pathways to be established between the wellhead structure and the remote control station. Thus, a cable 66 supplying communications and power from the surface is inductively coupled through the connector 64–62, through the internal portions of the system within the buoy K*a* and thence from the connector 63–65 arrangement through a cable 67 to the wellhead.

When the buoy has been released for flotation to the surface, electrical and power connections are made possible between the buoy and the wellhead via the cable 60. By this means, the buoy K*a* may be recovered at the water surface and direct access to the wellhead may be maintained through the cable 60 while any required servicing, repair or replacement is performed.

Figure 6:
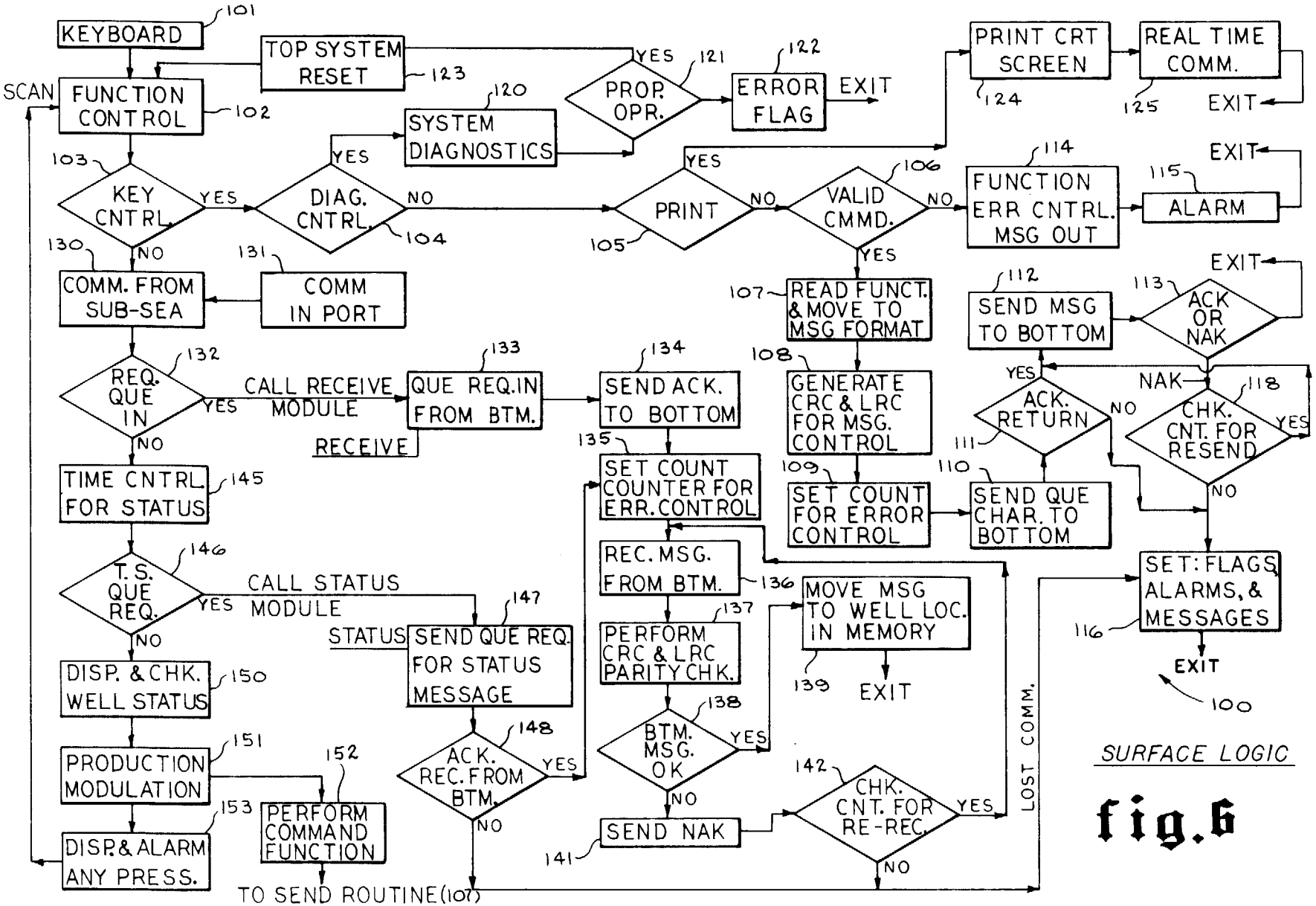
FIG. 6 is a flow diagram of the control logic employed at the surface location.

FIG. 6 is a flow diagram illustrating a logic control system 100 for the surface control unit 11. In general terms, the system 100 controls monitoring of the subsea well installation and also controls system access whereby operating personnel may transmit command signals to the subsurface unit 12. The system 100 is also responsible for control of the printing out or other recording of data obtained from the subsea installation and is equipped with provision for performing a self-checking function to detect problems within the surface unit 11. As a part of the monitoring function, the system 100 is equipped with means to automatically, or in response to a manual entry, provide data regarding the status of the subsea wellhead equipment and also to provide an indication of a malfunction in the communications between the surface and subsea units.

As an example of the operation of the logic control system 100, assume that an operator input at block 101 (the keyboard) is applied to the logic system 100 via a function control block 102. The system 100 constantly scans the keyboard for any input. While a scanning detection technique is described for use in the preferred embodiment of the system 100, it will be understood that an interrupt technique initiated by a signal from the keyboard could also be employed in the system. In the description which follows, blocks or diamonds in the flow diagrams are described as performing certain functions. It will be understood, however, that this terminology is employed as an expedient and that the flow diagram is intended to indicate the sequence of performance of various logical operations and control functions by the circuitry and equipment included in the surface and subsea units 11 and 12, respectively. In the scanning mode, the block 102 sequentially scans output positions from the keyboard operator block 101 to determine whether or not a particular command or status signal has been initiated by the operator.

One of the functions of the block 102 is also to determine whether or not a correct initiating signal has been input by the keyboard operator. If desired, suchan initiating signal, or "password", can be produced by depressing a particular sequence of function or command keys on the keyboard or by inserting a given control number into the keyboard by the operator with any other sequence or number not providing the needed input for securing access to the system. Once the proper password has been set into the keyboard 101, the system 100 is ready to receive subsequent commands from the operator. In the preferred embodiment, the operator, by inserting appropriate command or function signals, may place the system 100 into either an automatic or a manual mode. In the automatic mode, the system 100 will perform a predetermined series or sequence of functions when so directed by the operator. In the manual mode, the system prepares itself to receive and act on specific instructions placed into the keyboard by the operator. At this point, it may also be desired to require that a second password be inserted into the keyboard before operation in the manual mode is permitted. This latter requirement ensures that only authorized personnel can manually operate subsurface equipment thereby preventing unauthorized or unqualified personnel from operating the well in a manner which would cause damage or injury. In the automatic mode, the programs are inherently required to follow known sequences and procedures so that no dangerous or injurious subsurface activity occurs. In the manual mode, the operator has direct control over every individual operating system in the subsea installation which includes, for example, the ability to open a high pressure well into the sea.

The following is an exemplary listing of the different types of instructions which can be input to the system 100 through the keyboard 101. After the appropriate password for obtaining access to the automatic mode of operation, the operator may direct the system to perform the following functions:

a. open valves in the subsea well in a preset sequence;
b. close valves in the well in a preset sequence;
c. provide an output display at the surface unit 11 showing the status of the subsea well; and
d. perform a diagnostic routine to determine the condition of the subsea installation. Other automatic programs as desired may also be initiated.

In the manual mode, the operator may manually, sequentially command each of the of the individual functions performed in the sequence of functions provided in the automatic mode, and in addition may perform the following specific functions:

a. release or recall a buoy; and b. open or close any control valve which is tied into the system. Any other controllable functions which can be operated from the surface may also be manually directed when the system is in the manual mode.

Continuing with the description of the system 100, it is now assumed that the keyboard is open, the system is in an automatic mode, and the operator has depressed a function key to command the system to open valves in a subsea well in a preset sequence. The presence of an instruction is recognized by the function control 102. A key control diamond 103, constantly seeking an answer to the question of whether or not an input has been detected by the function key control 102, provides a "yes" answer and a second diamond 104 asks the question of whether or not the input signal is for diagnostic control. In this hypothetical situation, the answer would be "no" and the program moves to diamond 105 which requests whether or not the input is a print instruction. In this case, the answer being "no", another diamond 106 asks the question whether or not the instruction is a valid command for operation in the automatic mode. If the answer is "yes", the instruction signal is sent to block 107. The tests required in the various diamond or test functions employed in the logic control system of the present invention may be performed using a data masking technique or a "rotate right" technique or any other logical operation for determining the content or validity of a logical signal.

Figure 8:
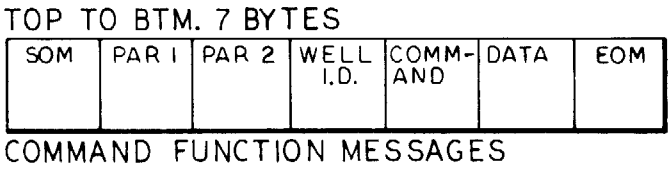
FIG. 8 is a graphical representation of the format for messages sent from the surface to the subsea system.

When the block 107 receives a valid command signal, it reads the function encoded in the signal and prepares mission to the subsea system. The block 107 in preparing the command signal for message format form places the message into a predetermined location in a suitable memory. A preferred form of the message format for transmission to the subsea system is illustrated in FIG. 8. The memory for the message is preferably of the type which has a record seven bytes long with the following fields: start of message; parity 1; parity 2, well identification (ID); command function; data; and end of message. By way of example, the "command function" field or byte would indicate that a valve is to be opened and the "data" byte would indicate which particular valve was to be opened. The EOM byte illustrated in FIG. 8 indicates that the end of the message is present. The SOM byte is the first character of the message and indicates to the subsea system that a message is starting. The parity 1 and parity 2 bytes are added by the block 108 which generates a CRC (circular redundancy check) and an LRC (longitudinal redundancy check) for message control. These two operations will be more fully described hereinafter.

In the preferred form of the system, each word employed is 8 bits long. Accordingly, it will be appreciated that the command byte may include as many as 256 separate instructions in an 8-bit word system. While a 7-byte message is desirable, it will be understood that a message having a smaller or larger number of bytes may also be employed in a particular system. Block 107 provides the information for the command byte and the data byte if data is appropriate. In the example under consideration requiring a preset sequence of valve openings in the automatic mode, there would be no data information.

Function 107 supplies the necessary information in the first byte indicating start of message, the information in the last byte indicating end of message and the information regarding well ID. The well ID information is initially put into the signal by the operator.

Block 108 generates 2 bytes of data, parity 1 and parity 2, which are employed for polynomial error detection whereby the message transmitted to the subsea system may be verified by the subsea system as having been correctly or incorrectly received using only the data encoded within the message to the surface for verification. Any suitable method for implementing polynomial error detection codes may be employed. Examples of CRC techniques are described in an article entitled "An Efficient Soft Ware Method for Implement Polynomial Error Detection Codes" by Joseph S. Whiting, printed in the March 1975 issue of Computer Design. An LRC system is also employed in the system 100 to provide dual verification. In the LRC technique, the parity 2 byte is rotated by the number of characters within the message itself in a manner analogous to the operation performed in the CRC technique. The LRC and CRC are both conventional techniques for data verification and, per se, form no part of the present invention except as they are used in combination with the other features of the system.

Block 109 is a counter which determines the number of attempts which will be permitted to transmit the message, in the format shown in FIG. 8, to the subsea system before an error is indicated. At the end of the selected number of attempted transmissions, the system 100 recognizes a malfunction in communication with the subsea system and initiates subsequent operations as will hereinafter be described.

Block 110 sends a cue character to the subsea system to indicate that a command message will be following. Other cue signals from other parts of the system to announce other messages are also sent to the subsea system as will be described. When the subsea system has received the cue (or "que") character sent by the block 110, it returns an acknowledge return (ACK) signal to the surface acknowledging receipt of such cue signal. By way of example, the cue signal sent to the bottom preceeding a command message is an "03" and the standard ACK signal transmitted from the bottom to the surface system is an "06". If the acknowledgement signal has been received at the surface, the diamond 111 provides a "yes" answer and the message is transmitted to the subsea system at function 112. The subsea unit, upon receipt of the message, performs a parity check using parity 1 and parity 2 (the CRC and LRC techniques) to determine if a valid message has been received. If a valid message has been received, an acknowledgement signal ("06") will be transmitted from the subsea system and the diamond 113 will form a "yes" answer. If receipt of the signal is acknowledged, the program is then exited and returned to caller. As will be understood, each exit from the program includes a return to the caller.

The message sent to the subsea system from block 112 is conveyed to any suitable universal asynchronous receiver and transmitter (UART) (not illustrated) which performs the actual transmission to the subsea system. The eight-bit word in the message is input to the UART in parallel form and placed in a transmit holding register (THR). The UART creates the parity for that particular word and sets the number of start and stop bits to be used in the transmission. One start bit and two stop bits are preferably affixed to the word to be transmitted to the subsea system where a corresponding UART is located. The subsea unit uses the start bits and stop bits for synchronizing in on the word. This permits a hardware parity check to occur since if any noise is introduced into the transmission, it will be immediately detected by the subsea UART. The errors which may occur during the transmission are an overrun error, a framing error or a parity error. If the subsea UART detects an error in a word transmission, it signals this fact to the subsea logic. The subsea logic may use either this signal, or, as is the case in the preferred embodiment, the failure of the parity 1 or parity 2 to check because of the error in transmission to initiate a NAK signal to the surface requiring retransmission of the block message. The UART sets up the message in a serial fashion for transmission over the dual conductor in the cable. The subsea UART removes the start bit, stop bits and parity and presents the remaining eight bits of data to the CPU 42 in the subsea system.

The procedure as described to this point has presumed a correctly initiated command signal and receipt of the corresponding command message by the subsurface system. In the event the operator, havng entered the proper password, should thereafter enter a command which would not be a valid command for operation in the automatic mode, the diamond 106 forms a "no" answer to indicate that a function error is present and a block 114 generates an alarm 115. The program is then exited and returned to the operator. No further control operations or transmission are performed by the system at this point. By way of example, if the operator has access only to the automatic mode operation of the system and depresses a function key on the keyboard which would require that a particular subsea valve be opened or closed, contrary to any program in the automatic mode, this would be detected as an improper instruction to signal an alarm. The alarm 115 may assume any number of different forms, it may be an audio alarm or it may simply be a message printed on a cathode ray tube or other print-out or recording mechanism.

Assuming that a proper automatic instruction has been entered into the system but, after a predetermined period of time, the diamond 111 still does not have an acknowledge return signal from the subsea system, that is, there is a "NAK" of the cue character, the system takes the "no" exit from diamond 111 and goes to a lost communications subroutine. At this point, a block 116 functions to set alarms, set messages or to perform any other desired function indicating that receipt of the cue character sent to the subsea system has not been acknowledged. As will be hereinafter more fully explained, the block 116 records the fact that an emergency condition exists and other equipment in the system implements the alarms, flags, or messages when the status of the block 116 is interrogated and it is determined that a flag, alarm or message condition exists. After performance of a block 116 function, the subroutine is then exited and returned to the caller.

The next error factor is in diamond 118 which determines whether or not the message has been transmitted the number of times set in the block 109. If the message has been transmitted the required number of times but its receipt has not yet been acknowledged, diamond 118 provides a "no" answer to again initiate operation of the block 116. If the number of attempted transmissions has not exceeded the number set in block 109, the program takes the "yes" output from 118 and then attempts to resend the message at 112. The "no" exits to the diamonds 111 and 118 occur in situations where some communication problem between the surface and subsea units has occurred.

Assume now that the operator wishes to perform a diagnostic operation in which the system 100 runs through a test to verify its own proper operation. The initiating signal is received at block 102 and determined to be a key control signal at diamond 103 with recognition at diamond 104 that the signal is a diagnostic signal. The signal is then directed to the block 120 which initiates a predetermined sequence of diagnostic procedures to determine if the system 100 is operating properly. The diamond 121, if a "yes" answer to the question of proper operation is made, transmits the signal back to a reset function 123 which provides a total system reset for the system 100. If a "no" answer is obtained by the diamond 121, the block 122 provides a flag or alarm, exits and returns to the caller so that appropriate corrective procedures may be undertaken. A signal output from the block 122 indicates improper operation of one or more components in the system 100.

Assuming that the operator wishes to have a visual display of the status of one or more of the subsurface wells, the appropriate signal is entered in the keyboard operator 101 and such signal is recognized by the diamond 105 to initiate the block 124 for printing on a CRT screen. Other visual reporting techniques or devices may be initiated at 124 to provide a recorded indication of well status. Block 125 indicates an optional function of the system whereby the data obtained from the subsea installation can be transmitted from the surface unit 11 to some remote monitoring or master control location over existing communication linkages or by a conventional transmitter or otherwise.

The diamond 106 also determines if proper operator signals are entered while the system is in the manual mode. The responses to this question are handled in the previously described manner for the question asked relative to operation in the automatic mode. By way of example, if the keyboard operator signal indicated that a given valve was to be opened and the system was not in the manual mode, the diamond 106 would provide a "no" answer. On the other hand, if the system is in manual mode and any proper manual signal instruction is applied to the keyboard, a "yes" answer will be produced at the diamond 106. As previously mentioned, the manual operation requires, in the preferred embodiment, that a special password be inserted into the keyboard. The diamond 106 determines whether or not the special password preceded the instruction for a manual operation.

Now, turning to the handling of the messages or information signals received from the subsea installation by the unit 100, the key control diamond 103 prevents routines along the "no" exit from operation during the time that a keyboard operator input is occurring. If the key control 103 provides a "no" answer, indicating no operator input, block 130 receives data from the subsea system via a communications input port 131. Diamond 132 asks whether or not block 130 has received data from the communications input port and, if the answer is "yes", causes the receive function 133 to be called in. If block 133 receives, from the subsea system, the necessary que request, in our example, the code "07", block 134 sends an acknowledgment to the bottom acknowledging receipt of the que request. Block 135 functions, in a manner similar to the block 109, to determine the number of permitted attempts at receiving the message from the subsea system. If the message is not received within the permitted number of attempts, the lost control routine, block 116 et seq, will be activated.

Figure 9:
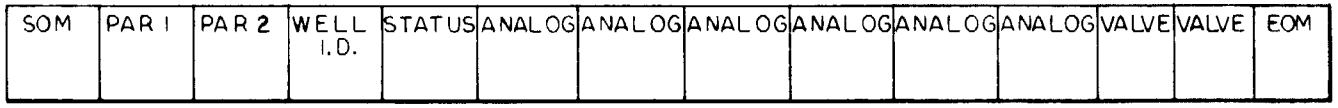
FIG. 9 is a graphical representation of the format for messages sent from the subsea system to the surface.

Block 136 receives the data being sent up from the subsea system. The data is in the form of a status message, preferably in the form of 14 bytes as best indicated in FIG. 9. In addition to the start of message (SOM), parity 1, parity 2, well ID, status and end of message (EOM), there are several analog bytes which can show temperature, pressure or any other variable parameter and two valve bytes which indicate valve status. The status message illustrated in FIG. 9 is illustrative and, as is the case with the status message in FIG. 8, a smaller or larger number of bytes may be employed in the message depending upon the information desired to be transmitted.

The valve bytes can provide information for eight different valves, i.e., whether each of eight valves is opened or closed or in some other intermediate position. Parity 1 and parity 2 in the status message are employed, as with the command message, to determine that a proper or correct message has been received. The parity is performed on the bytes between and including well ID and the valve bytes. The function 137 performs CRC and LRC parity checks and the diamond 138 determines whether or not the checks indicated that the message was properly received.

If the message was properly received, function 139, the set message function, moves the information regarding the well status to a predetermined place in a system 100 memory. As will be explained, the information stored in the system 100 memory is periodically called upon by the system in another subroutine to provide continuous and updated displays of well status for each well in the system. Following the entry of the status into the memory as indicated at block 139, the subroutine exits to the caller.

Assuming that diamond 138 indicates that the message from the bottom was not properly received, a block 141 sends a NAK signal to the subsea system and a diamond 142 determines whether or not the number of transmissions attempted from the subsurface unit to the surface unit is less than the number set in the counter control 135. If it is less than the selected number, the surface system 100 again attempts to receive the signal and when the selected number of attempts is exceeded, the diamond 142 forms a "no" answer which actuates the block 116 which functions as previously described.

A subroutine beginning at the "no" exit of diamond 132 is employed to automatically run status checks on the subsea system in a preset time loop. Function 145 operates to determine the time interval between subsequent status reviews. Diamond 146 determines whether it is time to obtain status reports from the subsea system. If the answer is "yes", the block 147 sends a que request (an "07") for status to the subsea system. A diamond 148 determines whether or not the subsea system has received the que request and sent up an acknowledgement. If an ACK is received within a given period of time, the subroutine beginning at block 135 is reinitiated and the procedure is repeated the number of times set into the counter. If an acknowledgement is not received from the bottom within the predetermined time period, the "no" exit is taken from diamond 148 and the function 116 is initiated.

If the answer from the diamond 146 is "no", indicating that the time for a status report has not yet occurred, a block 150 function is initiated to display and check the status of the wells. This subroutine, beginning at block 150, determines the presence of a set flag, alarm or message in the block 116 and performs other functions which may be required to determine the status of the wells. Block 151 is an optional feature, which for example may indicate that the well production may be automatically modulated as required to meet some predetermined limits. Based on the information regarding well status obtained from the block 150, the block 151 can dictate a command signal via the block 152 which then functions through the block 107 to require a particular valve or group of valves to open or close as needed to produce one or more wells at a predetermined flow rate. This type feature, as well as any other control functions which may be required to control pressure, temperature or other variable parameters may be introduced at this point in the program. Block 153, when the block 150 indicates that a set alarm, flag or message is present in block 116, actuates a predetermined alarm or display to reflect the situation. In the specific example of FIG. 6, the block 153 is sensitive to the presence of well pressures, temperature, or lost communications between the surface and subsea units.

Figure 7:
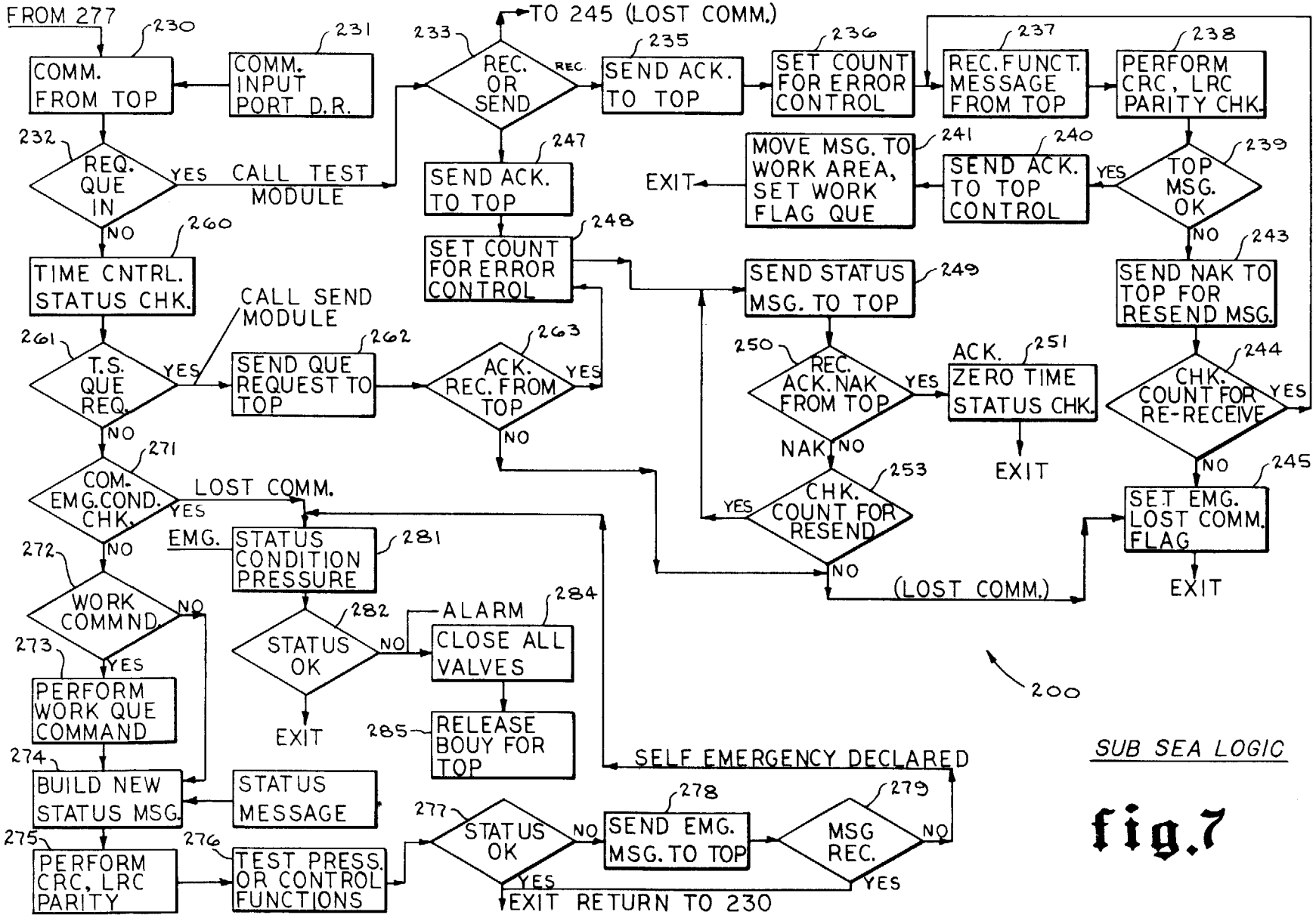
FIG. 7 is a flow diagram of the control logic employed at the subsea location.

A subsea system 200, shown in FIG. 7 is similar in operation to the surface system 100. The system 200 functions such that if proper communications exist between the surface and subsea installations, but a well condition has exceeded some predetermined limit, the information regarding the particular parameter which has been exceeded is transmitted to the surface where a decision regarding subsequent handling of the emergency or abnormality is to be made. In the event communications have been interrupted or lost but the well or wells are operating within established limits, such operation is permitted to continue in normal fashion as though communications with the surface were still complete. If a well condition is exceeded, signalling an abnormal situation, a predetermined program is initiated within the subsea system 200 to effect a particular result, which in the case of the preferred embodiment would require that the well be completely closed and the buoy K released. Such an abnormal situation would be, for example, an excessive flow rate, pressure, or temperature value.

In the system 200, the signal transmitted from the surface is supplied through a communications input port 231 to the communications block 230. The diamond 232 determines whether or not there is a message at the communications input port 231. If the answer is "yes", a diamond 233 determines whether the message is a command or a request for a status report. An "05" in the message indicates a request for status, while an "07" indicates a command signal. If the information is neither an "05" nor an "07", a loss of communications is indicated in which case a lost communications subroutine is initiated as will hereinafter be more fully explained.

Assuming that a command signal was received, a block 235 sends an acknowledgement signal to the surface system. A block 236 sets the number of repeat attempts which will be made to receive a correct command signal before an error is indicated. A block 237 receives the function message from the surface and a block 238 performs the necessary parity check to verify that a message has been properly received.

A diamond function 239 determines whether or not a message was properly received. If the message was properly received, a function 240 sends an acknowledgement signal to the surface to so signify. At this point, the validly or properly received command signal is relayed to a system 200 memory (not illustrated) by a function 241 to provide a record which is periodically checked by another subroutine in the system.

After the message has been put in the system memory and an appropriate flag set, the program is excited and returned to caller. If the diamond 239 indicated that the message from the top was not properly received, a block 243 sends a NAK signal to the top which requires that the message be retransmitted. Block 244 determines whether or not the number of retransmissions of the message is within the limit set by the block 236. If the limit has not been exceeded, the loop is reinitiated to the block 237. If the number of attempts at receipt of the proper message exceeds the limit, function 245 advises the system memory that a lost communication emergency exists. As will be explained, this information is picked up by one of the other subroutines in the system as it periodically scans the memory. Thereafter, the program is exited and returned to the caller.

If the message transmitted to the subsea system calls for status information, a block 247 sends an acknowledgment to the surface to signify that the status request message has been received. A block 248 sets the number of attempts at transmitting the status message to the surface and a block 249 causes the information regarding well condition recorded in the system memory to be sent to the surface.

A diamond 250 determines whether or not the status message was received by the surface. If the information was received, a block 251 resets the status check time to zero. As will be described, the status check time is used in a procedure which periodically determines or verifies that communications with the surface are still existing. Because of having received a request for status information, the subsea system 200 recognizes that communications existed as of the time of receipt of such request and the periodic time check sequence can therefore be reset to zero as of the time of receipt of any message. If a NAK is detected at 250, diamond 253 determines whether or not the number of permitted attempts at sending the status to the surface has been exceeded and if not exceeded, the system returns to block 249. When the count set in the unit 248 is exceeded, the "no" exit is taken from diamond 253 and the function 245 is initiated.

In the event that diamond 232 indicates that there is no information appearing in the communications input port 231, a time control status check block 260 is initiated. This block determines whether or not any communication has been received from the surface within a predetermined set period of time. A diamond 261 determines whether or not the time has been exceeded and if the time is exceeded, a function 262 sends a specific request to the top to determine whether or not communications are still present. A diamond function 263 determines whether or not the surface transmits a signal verifying receipt of the send que request signal. If an acknowledgment from the top is received, the block function 248 and the previously described following procedure are initiated. If the signal is not acknowledged, the function 245 is initiated.

If diamond 261 indicates that communications still exist with the surface unit, the "no" exit is taken and a diamond 271 determines whether or not an emergency condition exists by checking the function 245. If there is no emergency, as determined by a diamond 272, a block function 273 commands the subsea unit 12 to perform any work indicated by the message stored in the system memory by the function 241. If no work command has been received by the subsea unit, a block 274 initiates the building of a new status message whereby a message in the format illustrated in FIG. 9 is formed for transmission to the surface to take into account whatever work, if any, was performed. This updating also brings in the status of the wells including analog pressures and valve conditions. A block 275 encodes this status message with the CRC and LRC parity as previously described relative to block 108. A block 276 initiates a test of the various pressure or control values or functions and a diamond 277 provides a "no" answer if the values or functions exceed predetermined limits. A block 278 sends an emergency message to the top if the "no" exit from the diamond 277 is taken. A diamond 279 determines whether or not the message regarding the emergency has been received by the surface. If it has been received, the program exits at block 230 and is returned to the caller. If the message has not been received, a function 281 is initiated to declare an emergency. A "yes" answer from the diamond 271 also initiates operation of the block 281. Function 281 rechecks the status of all of the different monitored parameters to verify that all are within the prescribed limits or that one or more parameters has exceeded a prescribed limit. If a diamond 282 indicates that all parameters are within prescribed limits, the program is exited. If a prescribed limit is exceeded, a function 284 is initiated to cause automatic closure of all valves in the subsea system. A block 285 is then operative to release the buoy K (FIG. 1) for flotation to the surface.

Once the buoy K has been released, and following repair of the communications problem or the emergency situation, an appropriate retrieve buoy command signal can be entered in the keyboard 101 which is appropriately recorded in the system 200 memory through operation of the function 231 so that the work command from the diamond 272 may be employed to cause the buoy to be retrieved to its subsea position.

The foregoing disclosure and description of the invention is illustrative and explanatory thereof, and various changes in the size, shape and materials as well as in the details of the illustrated construction may be made within the scope of the appended claims without departing from the spirit of the invention. For example, the system of the present invention may be used in applications other than subsea or well type installations.

We claim:

1. A system for operating and controlling a plurality of subsurface wells and well control equipment from a remote surface control location comprising:

a. subsurface control and monitoring means including subsurface signal receiving means, subsurface signal generating means, subsurface signal transmitting means, and subsurface programmable logic control means for receiving signals from a remote surface control location, for generating monitor signals at subsurface well locations, and for transmitting said generated signals from said subsurface well locations according to a preprogrammed logical sequence independent of the receipt of surface generated signals from a remote surface control location; and b. surface control and monitoring means including primary power source means, surface signal receiving means, surface signal generating means, surface signal transmitting means, and surface programmable logic control means for receiving signals from a plurality of said subsurface control and monitoring means and from external surface signal sources, for generating surface signals for controlling and monitoring a plurality of said subsurface control and monitoring means, for transmitting said generated surface signals from a remote surface control location to a plurality of said subsurface control and monitoring means and for generating surface control signals in response to a preprogrammed logical sequence and in response to signals received from external surface signal sources.

2. A system as defined in claim 1 wherein said surface and subsurface signal transmitting and receiving means include primary electrical cable means forming a primary signal path between said remote surface control location and said plurality of subsurface control and monitoring means at said subsurface well locations.

3. A system as defined in claim 2 wherein said surface and subsurface signal transmitting and receiving means include means for inductively coupling conductors of said primary cable to said surface and subsurface transmitting and receiving means.

4. A system as defined in claim 2 wherein said surface and subsurface signal transmitting and receiving means include signal encoding means, signal multiplexing means, signal demultiplexing means and signal decoding means.

5. A system as defined in claim 2 wherein said subsurface control and monitoring means further includes a secondary electrical cable attached to a releasably mounted flotation means and means for releasing said flotation means to extend said secondary cable to the surface of a body of water thereby forming a secondary signal path between said surface and subsurface signal transmitting and receiving means.

6. The system of claim 5 wherein said flotation means contains a secondary electrical power source for powering said subsurface control and monitoring means.

7. A system as defined in claim 5 wherein said subsurface control and monitoring means further includes means for monitoring the status of said primary signal path and for activating said means for releasing said flotation means in response to the condition of said primary signal path, together with means responsive to said status monitoring means of said primary signal path for conditioning said subsurface programmable logic control means to assume control of said subsurface well and well control equipment independent of said surface control and monitoring means upon a response to the condition of said primary signal path.

8. A system as defined in claim 7 wherein said subsurface programmable logic control means includes means for monitoring critical parameters of well operation during the period when said subsurface programmable logic control means is in control of operation of subsurface well and well control equipment, and means for shutting off the flow of the subsurface well in response to the behavior of said critical parameters.

9. A system as defined in claim 7 wherein said subsurface programmable logic control means includes means for relinquishing independent control of the operation of the subsurface well and well control equipment upon receipt of a command signal from said surface control and monitoring means, and means for retrieving said flotation means upon such occurrence.

10. A system as defined in claim 2 wherein said surface and subsurface signal transmitting and receiving means include means for encoding, transmitting, receiving, decoding and verifying signals along said primary signal path in a predetermined signal format together with surface and subsurface located means for self-system diagnosis.

11. A system as defined in claim 1 wherein said surface control and monitoring means includes visual display means for displaying the status of surface and subsurface system components as a function of time.

* * * * *

UNITED STATES PATENT AND TRADEMARK OFFICE

CERTIFICATE OF CORRECTION

PATENT NO. : 4,052,703

DATED : October 4, 1977

INVENTOR(S) : Jerry A. Collins and Robert L. Spaw

It is certified that error appears in the above-identified patent and that said Letters Patent are hereby corrected as shown below:

Column 2, line 34, delete "installion" and insert therefor --installation--.

Column 2, line 46, delete "primry" and insert therefor --primary--.

Column 2, line 52, delete "communiations" and insert therefor --communications--.

Column 4, line 49, delete "installtion" and insert therefor --installation--.

Column 7, line 41, delete "sterializing" and insert therefor --serializing--.

Column 7, line 49, after the word "framing" insert therefor --,overrun error detection and will signal the controller--.

Column 8, line 5, delete "hydrulic" and insert therefor --hydraulic--.

Column 9, line 17, delete "sutable" and insert therefor --suitable--.

Column 11, line 32, after the word "prepares" insert therefor --the system to place the signal in a message for trans---.

UNITED STATES PATENT AND TRADEMARK OFFICE

CERTIFICATE OF CORRECTION

PATENT NO. : 4,052,703

DATED : October 4, 1977

INVENTOR(S) : Jerry A. Collins and Robert L. Spaw

It is certified that error appears in the above-identified patent and that said Letters Patent are hereby corrected as shown below:

Column 12, line 8, after the word "message" insert therefor --and without the need for retransmitting the message--.

Column 13, line 21, delete "havng" and insert therefor --having--.

Column 17, line 5, delete "excited" and insert therefor --exited--.

Signed and Sealed this

Sixth Day of June 1978

[SEAL]

*Attest:*

RUTH C. MASON
*Attesting Officer*

DONALD W. BANNER
*Commissioner of Patents and Trademarks*